US006076817A

United States Patent [19]

Kobayashi et al.

[11] Patent Number: 6,076,817

[45] **Date of Patent: *Jun. 20, 2000**

[54] FINISHER

[75] Inventors: Tadashi Kobayashi, Toyokawa; Hiroyuki Yoshikawa, Aichi-ken; Yuusuke Morigami, Toyohashi, all of Japan

[73] Assignee: Minolta Co., Ltd., Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/999,495

[22] Filed: Dec. 29, 1997

[30] Foreign Application Priority Data

Dec. 27, 1996 [JP] Japan ..... 8-351547

[51] Int. Cl.[7] ..... B65H 33/04; G03G 15/00

[52] U.S. Cl. ..... 270/58.09; 399/19; 399/83; 399/408; 399/410

[58] Field of Search ..... 270/52.18, 58.09, 270/58.08, 58.12, 58.23, 52.01, 52.04, 58.05; 399/18, 19, 83, 85, 87, 408, 410

[56] References Cited

U.S. PATENT DOCUMENTS 4,592,651 6/1986 Oikawa et al. ..... 355/72
5,032,876 7/1991 Murakami ..... 355/324
5,107,299 4/1992 Farrell et al. ..... 399/408 X
5,177,548 1/1993 Nakamura et al. ..... 270/53 X
5,382,011 1/1995 Tani ..... 270/37
5,573,233 11/1996 Hirai et al. ..... 270/58.08

*Primary Examiner*—Christopher P. Ellis
*Assistant Examiner*—Kenneth W. Bower
*Attorney, Agent, or Firm*—Sidley & Austin

[57] ABSTRACT

A finisher is disclosed which is connected to a copying machine and possessed of a stapler which effects a stapling treatment on the sheets discharged from the copying machine and a binder which inserts the discharged sheets into a cover and binds by adhesion the sheets and the cover for bookbinding. This finisher has a memory for memorizing the stapling treatment or the binding treatment as a treating mode in advance, a staple sensor for detecting the existence of the staple, and a cover sensor for detecting the existence of the cover. When either of the sensors detects the lack of staple or cover, a feasible treating mode other than the unfeasible treating mode due to the lack of staple or cover in the treating mode memorized in the memory is executed prior to the unfeasible treating mode.

30 Claims, 8 Drawing Sheets

FINISHER

BACKGROUND OF THE INVENTION

1. Field of the Invention

This invention relates to an finisher connected to an image forming apparatus such as a copying machine or a printer and adapted to serve the purpose of, for example, bundling and stapling a plurality of copied or printed sheets, automatically encasing the stapled bundles of sheets with a cover specially designed for enclosure and binding a book.

2. Description of the Related Art

In recent years, as to what is called OA apparatuses, the improvement of each category of performance, such as enlargement of the capacity and reduction of the processing time, has been accomplished for efficient office use.

Among these OA apparatuses, the copying machine has already arrived at maturity in respect of basic performance. Recently, while maintaining high performance, new copying machines endowed with various value added functions to automate the operations which have been done manually have been developed.

As one of these apparatuses having value added functions, for example, an apparatus which automatically performs a part of filing works that have been done manually up to now, such as collecting sheets discharged from a copying machine or a printer automatically, binding a bundle of these sheets with staples, punching holes in the sheets, and moreover, encasing the copied or printed sheets with a cover and automatically starching them for bookbinding, has been developed. Such an apparatus to perform works on the discharged sheets is called a finisher.

In such a finisher uniting a plurality of functions, however, there is a possibility that all functions are suspended by a functional stop of a part of one function in such a case when the part thereof has, although not having trouble, become impossible to operate. For example, in the case where it has run out of the staple needles, although the bookbinding by a cover binding is still possible, all functions are stopped and, depending on circumstances, even the copying machine or the printer to which the finisher is connected is also made to quit its operation. The same problem happens when the binding cover is used up, and it causes the deterioration of efficiency in using the copying machine.

Such problems are especially remarkable with a multifunctional copying machine. For example, in a copying machine possessed of what is called reserved copying function which is enabled to introduce a plurality of sets of documents in advance and perform each different treatment set by set, when doing a reserved copying operation in such a manner as the first job corresponds to a stapling treatment, the second job to a binding treatment, and the third job to a stapling treatment, the first job stops its execution without staples and, even if the following second job of the binding treatment is feasible, all jobs after the first job will stop their operations.

SUMMARY OF THE INVENTION

An object of this invention is to provide an enhanced finisher furnished with a plurality of functions such as stapling and binding. The finisher is enabled to do the other usable functions at first even if a part of the functions is unusable.

According to an aspect of the invention, a finisher connected to an image forming apparatus forming an image on a sheet and adapted to perform work on the sheet discharged from the image forming apparatus comprises a stapling device for effecting a stapling treatment on a plurality of sheets discharged from the image forming apparatus, a binding device which inserts the plurality of sheets discharged from the image forming apparatus into a cover having a fusible adhesive agent applied to the inner surface of the vicinity of a back part connecting front and back covers thereof and heats the back part of the cover to bind by adhesion the plurality of sheets and the cover for bookbinding, a treating mode memory device for memorizing a treatment by said stapling device or said binding device as a treating mode in advance, a staple detecting device for detecting the existence of a staple necessary for the stapling treatment executed by said stapling device, a cover detecting device for detecting the existence of the cover necessary for the bookbinding treatment executed by said binding device, and a controlling device which controls said stapling device or said binding device so as to execute, when a lack of staples or covers is detected, either by said staple detecting device or said cover detecting device, a feasible treating mode other than an unfeasible treating mode due to the detected lack of staples or covers in the treating mode memorized by said treating mode memory device prior to the unfeasible treating mode.

According to another aspect of the invention, a finisher comprises a stapler which effects a stapling treatment on a plurality of sheets, a binder which inserts the plurality of sheets into a cover and glues the plurality of sheets and the cover for bookbinding, a memory which memorizes a treatment by said stapler or binder as a treating mode in advance, and a controller which controls said stapler or said binder so as to execute a feasible treating mode other than a treating mode in an unfeasible state in the treating mode memorized in said memory prior to the treating mode in an unfeasible state.

According to still another aspect of the invention, a finisher incorporating therein a plurality of finishing parts for bundling a plurality of sheets and effecting a bookbinding comprises a memory which memorizes a treatment by said finisher as a treating mode in advance, and a controller which controls the plurality of finishing parts so as to execute a feasible treating mode other than a treating mode including the finishing part in an unfeasible state in the treating mode memorized in said memory prior to the treating mode including the finishing part in an unfeasible state.

DESCRIPTION OF THE PREFERRED EMBODIMENTS

Now, the embodiments of the above stated invention will be described below with reference to the accompanying drawings.

In the following, the construction of a copying machine having a finisher mounted therein, which comprises a plurality of finishing sections such as a stapler and a binder, will be described first. Then the operation of the machine will be described.

<<Overall Construction of System>>

Figure 1:
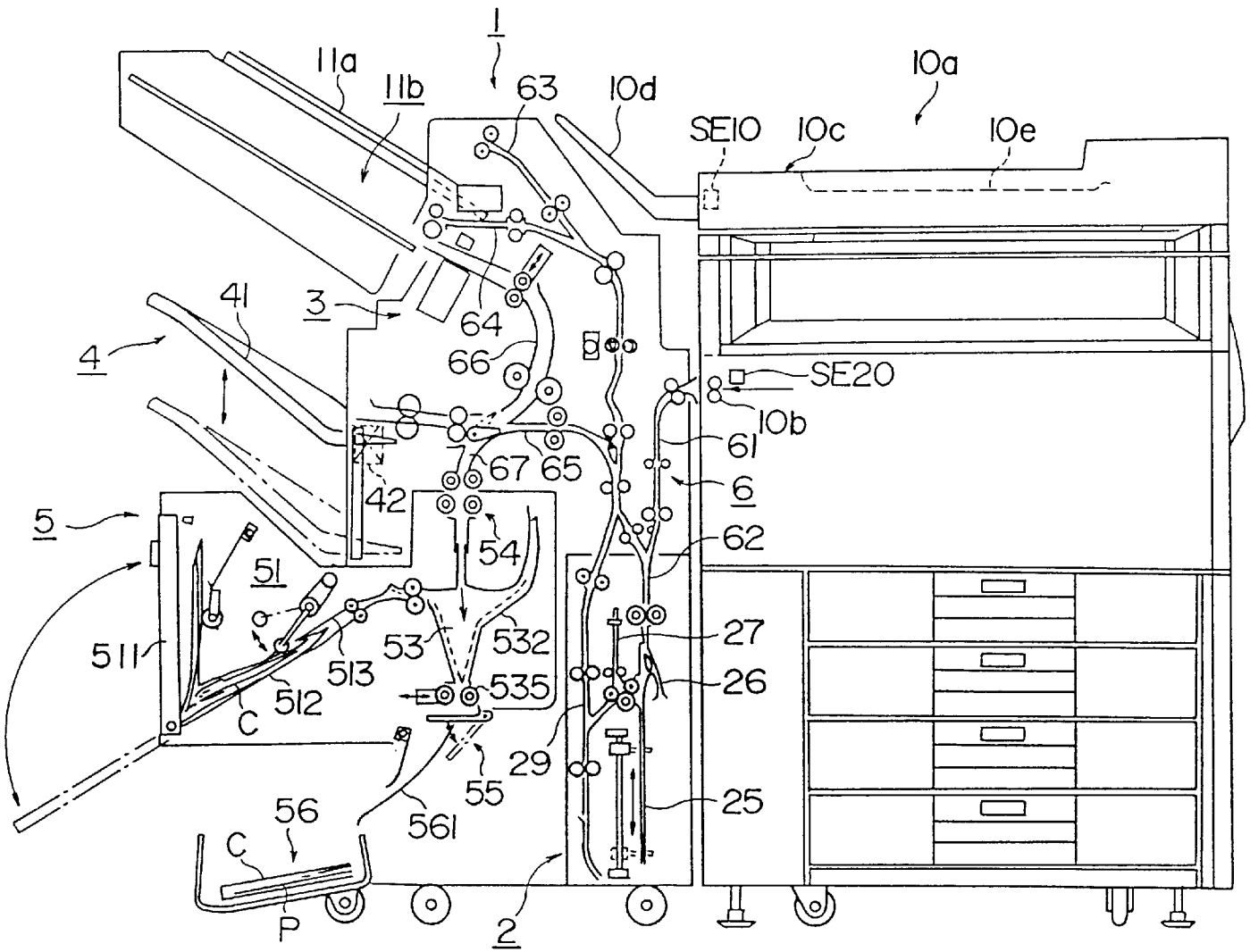
FIG. 1 is a diagram schematically illustrating the construction of a copying machine and a finisher according to one embodiment of the present invention.
Figure 2:
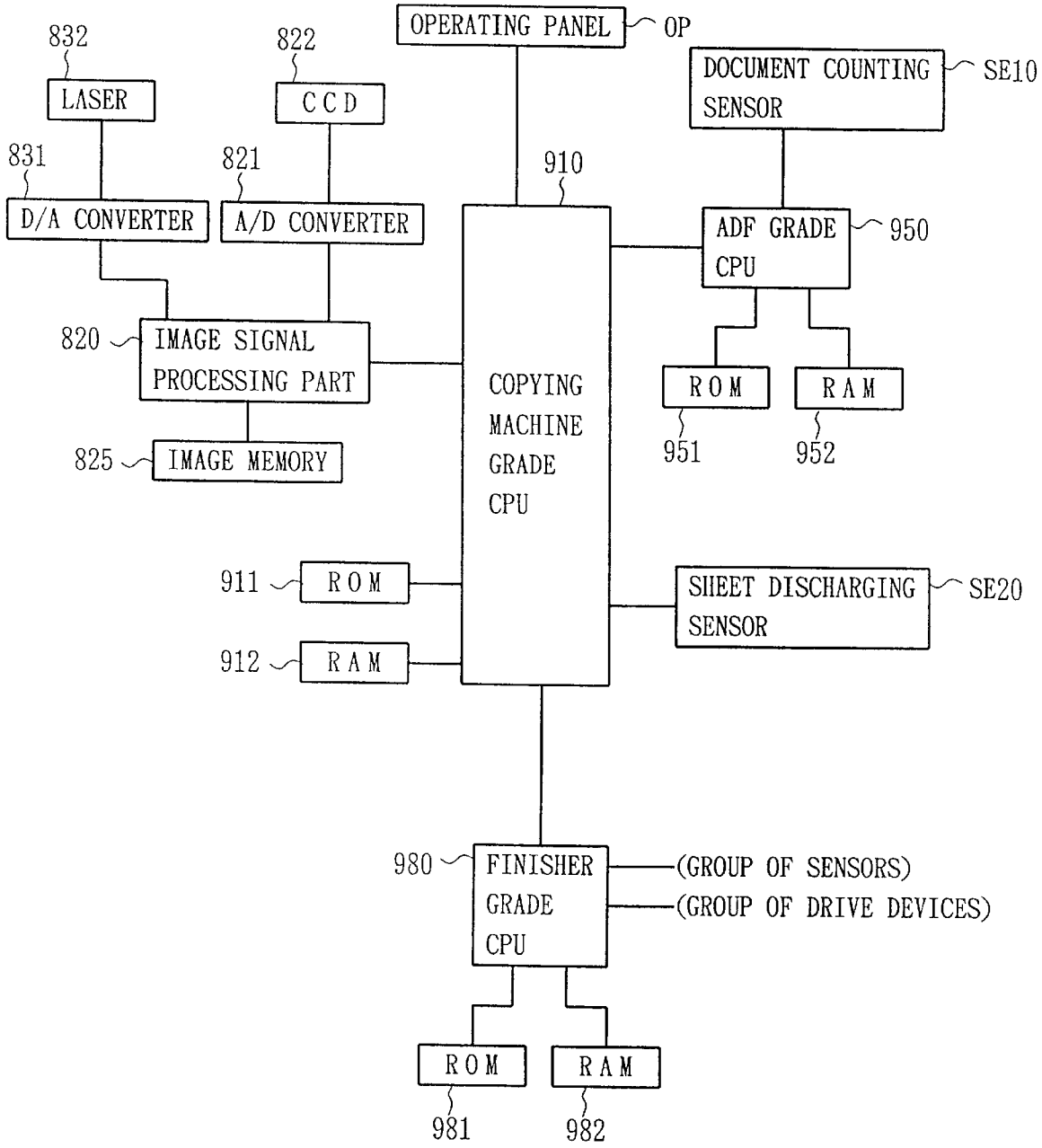
FIG. 2 is a block diagram describing a control system for the copying machine and the finisher.

FIG. 1 is a schematic diagram describing the overall construction of a copying machine having a finisher mounted therein and FIG. 2 is a block diagram of a control system of the copying machine including the finisher.

A copying machine 10*a* is an apparatus for producing an image on sheets by a well-known electrical photographic process, and discharging the copied sheets one by one from a sheet discharging part 10*b*. The copying machine 10*a* is furnished with an automatic document feeder (hereinafter referred to as "ADF") 10*c* on its upper part. This ADF 10*c* is used for the purpose of conveying a group of original documents laid on a tray 10*d* one by one onto a platen glass (not shown) of the copying machine 10*a* and discharging and piling the documents on a tray 10*e* after the images are read. The ADF 10*c* is supplied with a document count sensor SE10 which detects the number and size of the documents read in. Count of the number of the documents and detection of the size thereof are performed during the conveyance of the documents by the sensor SE10.

When the original document is set on the platen glass by the ADF 10*c*, the image on the original document is read by an image reader (not shown) built in the copying machine 10*a*, converted into digital data, and stored in an image memory of the control part. The copying output operation is executed by reading out the image data and adding the necessary compilations, such as enlargement or contraction, change of page order, image inversion, and making a copy to both sizes of a sheet.

As described below, to the copying machine 10*a* is connected a finisher 1 which is provided with a binder 5, a stapler 3, a sheet folding device 2, and punching device 7.

A control system which controls the operation of the whole copying machine (including ADF and finisher) is composed of such devices as a copying machine grade CPU 910 for controlling the copying machine 10*a*, an ADF grade CPU 950 for controlling the ADF 10*c*, and a finisher grade CPU 980 for controlling the finisher 1, as depicted in FIG. 2. The CPU's are provided with ROM's 911, 951, and 981 memorizing programs necessary for their functions and RAM's 912, 952, and 982 to be used by the CPU's for fulfilling various processings.

To the copying machine grade CPU 910 is connected an operating panel OP. Prompted by the directions from this operating panel OP, the commands such as bookbinding, stapling, sheet folding, and punching are introduced and the operations of each component of the copying machine are performed. To the copying machine grade CPU 910 is also connected an image signal processing part 820. To this image signal processing part 820 are connected a CCD sensor 822 of the image reader through the medium of an A/D converter 821 and a laser beam source 832 of the image producing system through the medium of a D/A converter 831. Further, an image memory 825 for memorizing a read image data is mounted on the image signal processing part 820.

To the copying machine grade CPU 910 is connected a sheet discharging sensor SE20 mounted in the vicinity of the sheet discharging part 10*b* of the copying machine 10*a*. The number of discharged copied sheets are counted by the sensor SE20.

The finisher grade CPU 980 is a device for controlling each part of the finisher and is connected to various kinds of sensors necessary for controlling each part (group of sensors) and driving motors and solenoids for operating each part (group of drive devices) which are described below.

To the ADF grade CPU 950 is connected the document counting sensor SE10 for detecting the number and size of the documents as described above.

Since the construction and the operation of the copying machine itself is the same as the general copying machines and is widely known, it will be omitted from further description.

<<General Structure of Finisher>>

Figure 3:
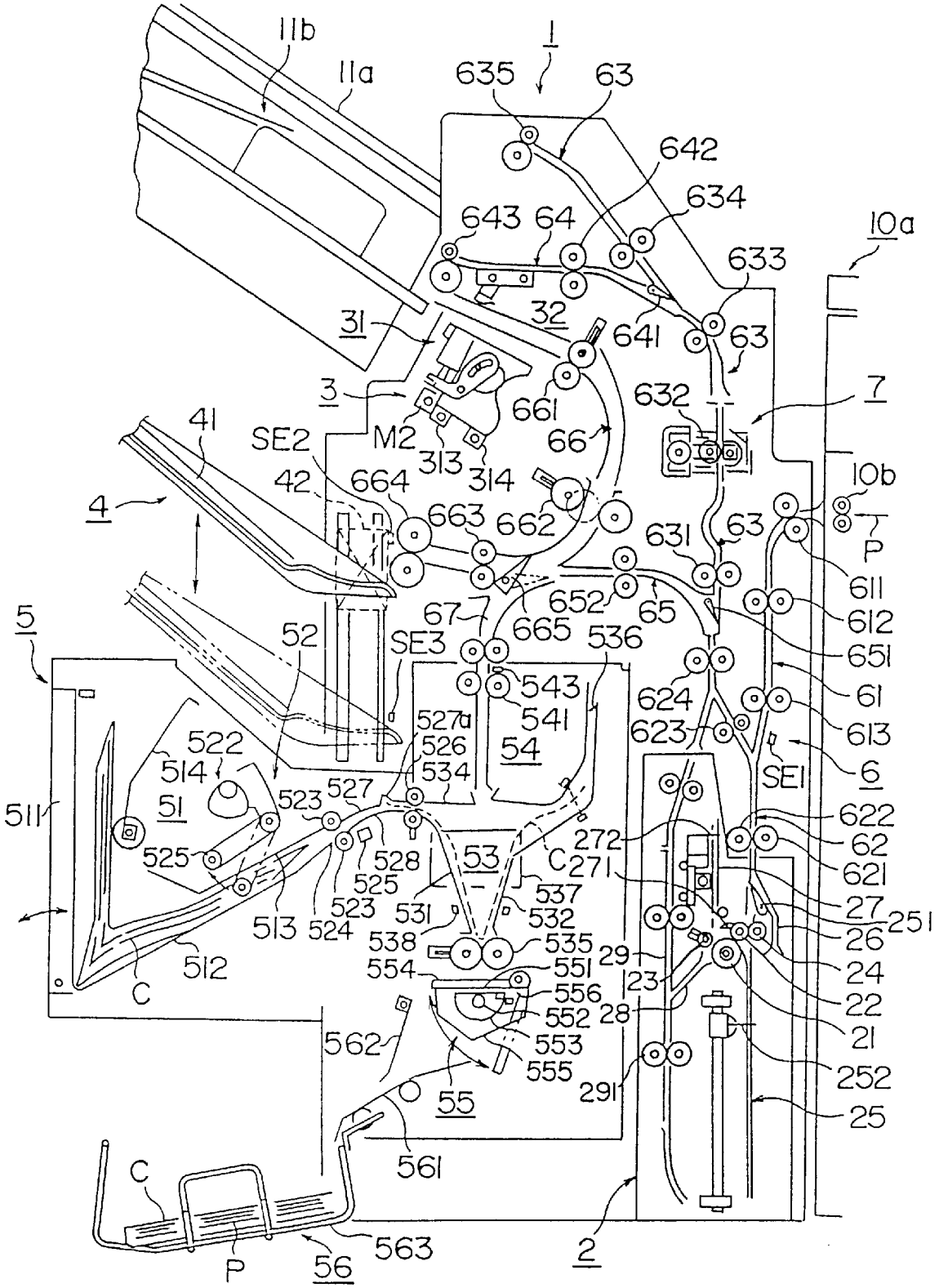
FIG. 3 is a diagram illustrating the construction of the finisher.

The finisher 1, as illustrated in FIG. 1 and FIG. 3, generally comprises a non-sorting tray 11*a* and a sheet accumulating part 11*b* accumulating and aligning sheets P discharged from the sheet discharging part 10*b* of the copying machine 10*a*, a sheet folding device 2 for optionally folding the sheet P discharged from the sheet discharging part 10*b* either doubly or triply in a cross section like a letter Z (hereinafter referred to as Z-folding), a stapler 3 disposed on the downstream side of the sheet accumulating part 11*b* in the direction of conveyance of sheet and adapted to perform a stapling treatment on the accumulated and aligned sheets P, a sorting part 4 for receiving and storing a bundle of sheets resulting from the stapling treatment, a binder 5 for attaching a cover to the bundle of sheets which has or has not undergone the stapling treatment, and a punching device 7 disposed in the sheet conveying path and adapted to punch the sheet P if desired. The sheets P discharged from the copying machine 10*a* are conveyed by the sheet conveying part 6 to various devices in the finisher 1.

<<Sheet Conveying Part>>

The sheet conveying part 6, as illustrated in FIG. 1 and FIG. 3, comprises a conveying path 61 for receiving the sheet P from the discharging part 10*b* of the copying machine 10*a* and conveying it downward. The sheet conveying part 6 includes a switchback conveying path 62 for inverting the sheet P longitudinally and upside down, a conveying path 63 for conveying the sheet P to the non-sorting tray 11*a*, a conveying path 64 branched from the conveying path 63 and adapted to convey the sheet P to the sheet accumulating part 11*b*, a conveying path 65 branched near the starting part of the conveying path 63 and adapted to convey the sheet P to the binder 5 or the sorting part 4, and a conveying path 66 for conveying a bundle of sheets from the sheet accumulating part 11*b* to the sorting part 4 or the binder 5. The sheet P is conveyed in the center of each of the conveying paths.

To be more specific, the conveying path 61 comprises paired conveying rollers 611, 612, and 613 as illustrated in FIG. 3. The switchback conveying path 62 comprises a conveying roller 621 capable of normal and reverse rotation, a follower roller 622 held in contact with the conveying roller 621 and enabled to rotate by following the conveying roller 621, paired conveying rollers 623 and 624 for conveying the sheet P which has been switched back to the conveying path 63, the conveying path 64, or the conveying path 65, and a sensor SE1 for detecting a sheet P.

The sheet P which has been conveyed down the conveying path 61 is first introduced into the switchback conveying path 62. When no folding is required, for example, the conveying roller 621 is switched to the reverse rotation and the sheet P is conveyed upward from the switchback conveying path 62 to the conveying path 63 when a prescribed time passes after the detection of the trailing end of the sheet P by the sensor SE1, namely when the trailing end of the sheet P enters the conveying path 62.

The conveying path 63 is provided with paired conveying rollers 631, 632, 633, and 634, paired discharging rollers 635, and the punching device 7. When the formation of a punched hole is designated, the punching device 7 punches a hole in the leading end part or the trailing end part of the sheet P.

The conveying path 64 is provided with a switch claw 641 for switching the destinations of the conveyance of the sheet P, paired conveying rollers 642 and paired discharging rollers 643 and adapted to discharge the sheet P into the sheet accumulating part 11*b*.

The conveying path 65 is provided with a switch claw 651 for switching the destinations of the conveyance of the sheet P and paired conveying rollers 652, and adapted to guide the sheet P directly to the binder 5 or the sorting part 4 instead of conveying the sheet P to the sheet accumulating part 11*b*.

The switch claws 641 and 651 are rotated by a solenoid (not shown) associated with each claw. The sheet P which has been delivered through the switchback conveying path 62 is guided by the switch claw 651 to either of the conveying paths 63 or 65.

The sheets P which have been accumulated and aligned by the sheet accumulating part 11*b* are optionally subjected to the stapling treatment. When they are discharged without any further treatments, they are guided to the sorting part 4 though the conveying path 66 which has a relatively large dimension. In contrast, when they are to be bound, they are optionally subjected to the stapling treatment and then guided to the binder 5 through the conveying path 67.

The conveying path 66 is provided with paired conveying rollers 661, 662, and 663 which are each enabled to be mutually separated, and is further provided at the leading end thereof with a discharging roller 664.

<<Sorting Part>>

The sorting part 4, as illustrated in FIG. 3, comprises a sorting tray 41 and a drive mechanism 42 for elevating the sorting tray 41. During the production of numerous copied sheets, the sheets P are delivered one by one through the conveying path 65 or a bundle of numerous sheets forwarded from the sheet accumulating part 11*b* to the stapler 3 and subjected therein to the stapling treatment is delivered through the conveying path 66 to this sorting tray 41. The single sheet P or the bundle of sheets conveyed through the conveying path 65 or the conveying path 66 is/are guided by the switch claw 665 to the sorting tray 41 or to the binder 5.

Whenever each of the sheets P received and accumulated in the sorting tray 41 is detected by a sensor SE2, the sorting tray 41 is lowered by a prescribed amount by the drive mechanism 42. When a sensor SE3 detects the fact that the sorting tray 41 has descended to the lower limit, the copying operation is discontinued because the sorting tray 41 is filled with the sheets to its full capacity. Since the construction of the drive mechanism 42 which lowers the sorting tray 41 by a prescribed amount is widely known, it will be omitted from further description.

<<Sheet Folding Device>>

The sheet folding device 2, as illustrated in the FIG. 1 and FIG. 3, is installed directly below the sheet conveying part 6 and is endowed with a function of doubly folding a sheet P bearing a formed image in the central part thereof in the direction of conveyance, a function of opening a doubly folded sheet P and imparting a crease of fold in the central part thereof, and a function of imparting a Z-folding to a sheet P.

It is three sheet folding rollers 21, 22, and 23 capable of normal and reverse rotation and a backup roller 24 that fulfill the central roles of the sheet folding device 2. The sheet P is delivered by a plurality of sheet conveying paths 25–29 which center around these rollers 21–24. Each sheet folding roller 21, 22, and 23 and the backup roller 24 are driven by the driving motors (not shown) specialized for each device.

Now, the sheet folding will be given a general description.

The sheet folding device 2 is endowed with two sheet folding modes of a Z-folding mode and a double-folding mode as sheet folding modes which can be selected by the manipulation of the operating panel OP of the copying machine proper 10*a*.

Z-folding Mode

This mode consists in folding a sheet P in a cross section like a letter Z. The sheet P emitted from the sheet discharging part 10*b* and delivered through the conveying paths 61 and 62 is conveyed by the paired switchback rollers 621 and 622, passes through the switching member 251, and is forwarded in the direction of the first conveying path 25. The sheet P is temporarily stopped by the sheet folding roller 22 and the backup roller 24 which are not in motion. Then, as the folding roller 22 is set driving, the sheet P is conveyed until it collides against a stopper 252 which is set at a prescribed position. The sheet P, on colliding against the stopper 252, is caused to form a loop in the vicinity of the sheet folding rollers 21 and 22. The first folding of the sheet P is effected as the loop is engulfed by the nip of the sheet folding rollers 21 and 22.

The sheet P on which the first folding is completed is conveyed to the second conveying path 27 by the switching motion of a switching member 271 promoted by the signal of the copying machine 10*a* designating a Z-folding and advanced until it collides against a stopper 272. The sheet P stopped by the stopper 272 is caused to form a loop in the vicinity of the folding rollers 21 and 23. The second folding is effected as this loop is engulfed by the nip of the folding rollers 21 and 23. The sheet P which has acquired a Z-folding in consequence of the second folding is conveyed to the third conveying path 28 and further conveyed in the direction of the switchback conveying path 29, at which it is diverted by the inversion of the paired switchback rollers 291 and forwarded in the direction of the conveying path 63.

Double Folding Mode

This mode consists in doubly folding a sheet P in the central part thereof. In this mode, the first folding is effected through the same process as in the Z-folding mode except that the position of the first stopper 252 is different from that during the first folding operation in the Z-folding mode. The sheet P on which the first folding is completed is directly conveyed to the nip of the folding rollers 21 and 23 because the switching member 271 seated at the entrance to the second conveying path 27 is not rotated so as to guide the sheet P to the second conveying path 27. In short, when the sheet P is passed through the sheet folding rollers 21 and 22 and then immediately engulfed in the nip of the sheet folding rollers 21 and 23, it is conveyed without any other treatments to the third conveying path 28 and then advanced to the switchback conveying path 29, at which it is diverted by the paired switchback rollers 291 and consequently conveyed in the direction of the conveying path 63 similar to the Z-folding mode. The side of the doubly folded sheet P which forms a crease of fold faces downward in FIG. 3 and the end part of the sheet P faces upward while the sheet is being conveyed.

Then, by opening the doubly folded sheet, a sheet with a crease in its center can be produced. During the process, the sheet folding rollers 21 and 22 for conveying the sheet P downward and paired switchback rollers 621 and 622 are switched to the reverse rotation. Then, the folded part of the sheet P slips out of the nip of the sheet folding rollers 21 and 22 and the sheet P is opened with a crease in its center. Then, the sheet is switched back with its trailing end switched to the leading end and again conveyed in the direction of the upstream side and consequently conveyed to the sheet accumulating part 11*b* through the conveying path 64.

When a Z-folded or doubly folded sheet is to be bound, the sheet is conveyed directly to the binder 5 through the conveying path 65, aligned with its end, and subjected to the binding treatment.

<<Stapler>>

Figure 4:
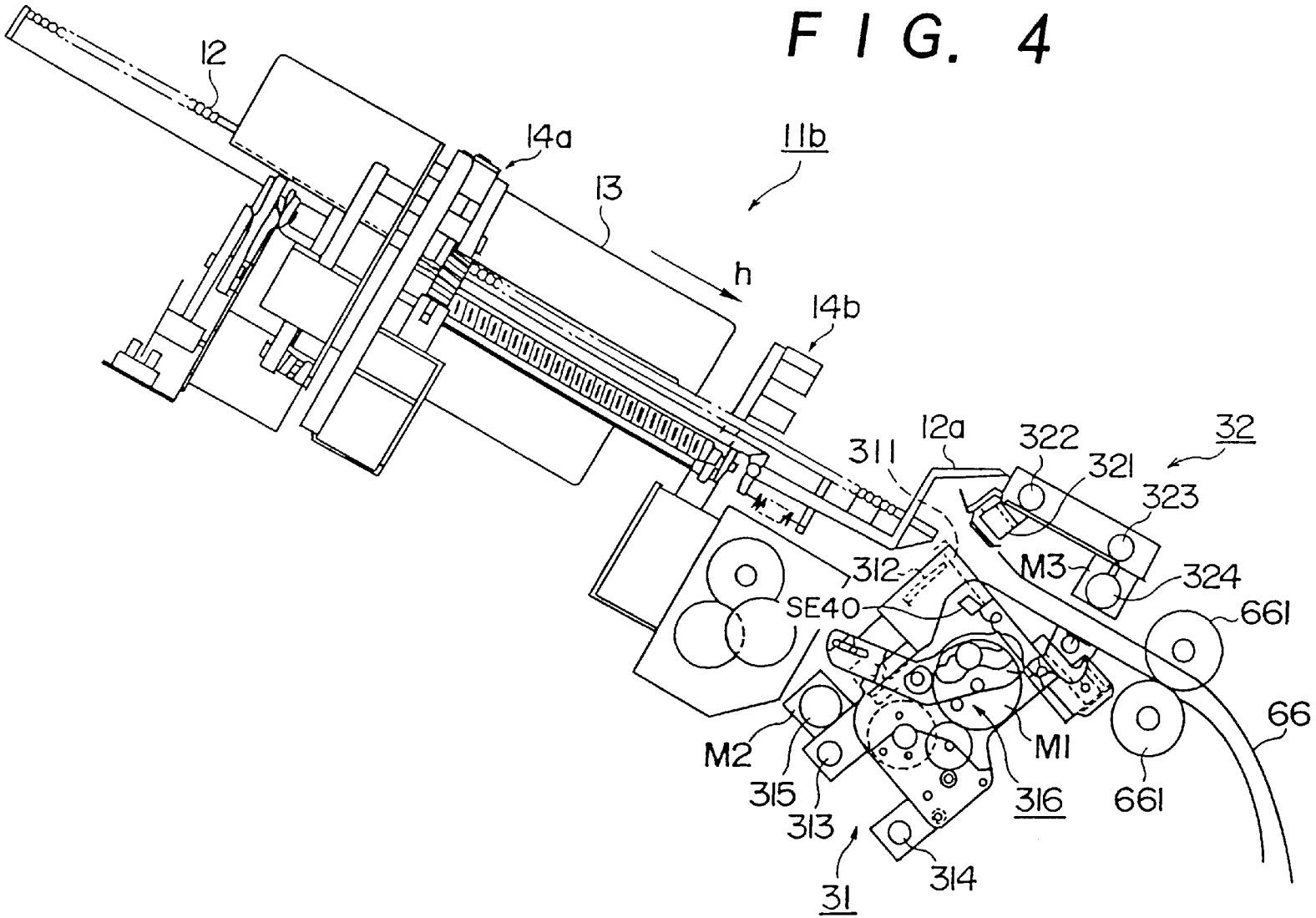
FIG. 4 is a diagram illustrating the construction of a stapler provided for the finisher.

The stapler 3, as illustrated in FIG. 3 and FIG. 4, consists in subjecting the sheet P emanating from the conveying path 64 to an aligning treatment at the sheet accumulating part 11*b* and then performing a stapling treatment on the bundle of sheets at a prescribed position. It comprises a staple ejecting part 31 serving the purpose of ejecting a staple and an staple receiving part 32 serving the purpose of receiving and bending the ejected staple.

The sheet accumulating part 11*b* aligns the sheets P in the lateral direction as the leading end stopper 12*a* receives and aligns the leading ends (trailing ends as viewed from the direction of discharge into the tray 12) of the sheets P discharged onto the tray 12 and a lateral aligning plate 13 reciprocates in a direction perpendicular to the direction of conveyance. Then, a first chuck device 14*a* and a second chuck device 14*b* take hold of the lateral part of the sheet P each time the sheet P is accumulated and aligned one by one and prevent the sheet P from floating up, and after the final sheet P is accumulated and aligned, the first chuck device 14*a* takes hold of a bundle of sheets and delivers it in the direction of the stapler 3.

The staple ejecting part 31 severs the individual staples of a staple cartridge 311 and bends them in the shape of three sides of a square one by one and thrusts them in the direction of the staple receiving part 32 as a staple. Severing and bending member 312 is actuated through the medium of a cam link mechanism 316 which is driven by a motor M1. The staple receiving part 32 is provided with a staple receiving member 321 serving the purpose of bending the thrusted staple and binding the bundle of sheets.

The staple ejecting part 31 is provided with a staple sensor SE 40 for detecting the existence of staples in the staple cartridge 311 and a detector (not shown) for detecting a staple jam. This staple jam detector is an electric current detector which, for example, detects the load current of the motor M1. It makes a decision that there is a staple jam when the detected amount of electric current exceeds a prescribed level (this judgment itself is made by the finisher grade CPU 980).

The position for driving a staple in a direction perpendicular to the direction h of conveyance of sheet is decided by mounting the staple ejecting part 31 on two guide shafts 313 and 314 so as to be slid freely thereon and, at the same time, adapting the staple ejecting part 31 so as to be moved by causing a spiral shaft 315 laid in a direction perpendicular to the direction h of conveyance of sheet to be normally and reversely rotated by a stepping motor M2 and also mounting the staple receiving part 32 on two guide shafts 322 and 323 so as to be freely slid thereon and adapting the staple receiving part 32 so as to be moved in a direction perpendicular to the direction h of conveyance of sheet in consequence of the normal and reverse rotation of a spiral shaft 324 driven by a stepping M3.

The position for driving a staple in the direction of conveyance of sheet is decided by the position of the first chuck device 14*a*. The stapling treatment, therefore, can be performed at any position between the leading end and the trailing end of the bundle of accumulated sheets, depending on the amount of advance of the first chuck device 14*a*. When the bundle of doubly folded sheets is to be bound, the bundle is pushed out until the end part of the bundle (the leading end as viewed from the direction of discharge into the tray 12) reaches the position of the staple ejecting part 31.

The bundle of sheets, after undergoing the stapling treatment, is nipped by the paired conveying rollers 661 which can be separated from each other and then conveyed by the conveying path 66.

The above are the structure and operation of the stapler 3. Since these are widely known, they are omitted from further description (Japanese Patent Application No. 08-66143, for example, describes such a structure and operation).

<<Binder>>

Figure 5:
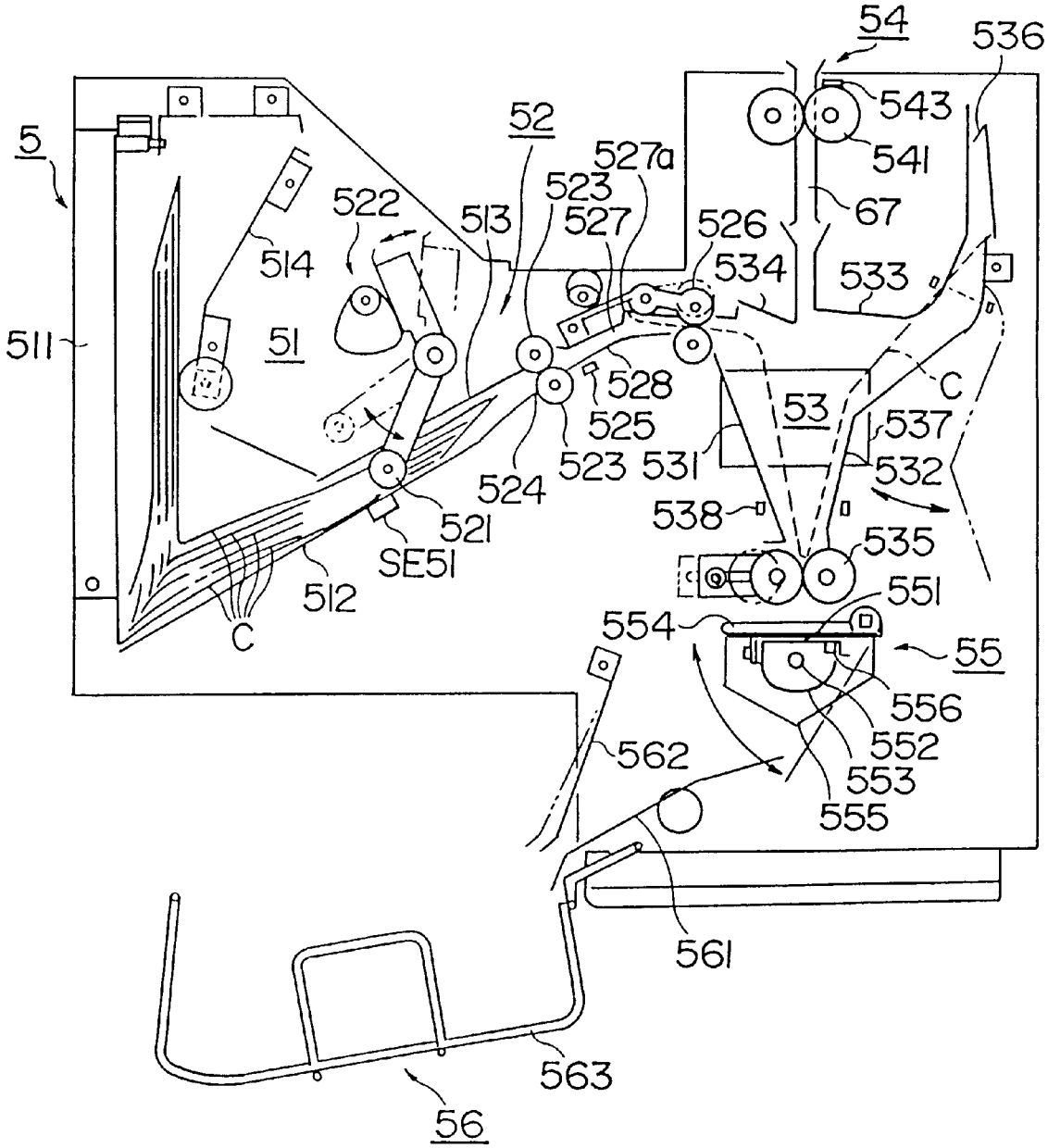
FIG. 5 is a diagram illustrating the construction of a binder provided for the finisher.

The binder 5 serves the purpose of bundling copied sheets and pasting the bundle by the use of a commercially available cover. This binder 5, as illustrated in FIG. 1, FIG. 3, and FIG. 5, comprises a cover storing part 51 for storing a plurality of commercially available binding covers, a cover conveying part 52 for extracting the covers one by one from the cover storing part 51 and conveying them, a sheet inserting part 53 for holding the covers C conveyed from the cover conveying part 52 in an opened state, a sheet conveying part 54 for inserting a bundle of sheets conveyed inside the conveying path 67 into a cover C, a heating part 55 for performing a heating treatment on the cover C which has admitted the sheet P at the sheet inserting part 53, and a discharging part 56 for discharging a booklet bound with the bound cover C out of the apparatus and receiving it for storage therein. Owing to this construction, the bundle of sheets which has been aligned in the sheet, accumulating part 11*b* is forwarded, either without any further treatments or after undergoing the stapling treatment, to the binder 5 through the conveying paths 66 and 67 and subjected to the binding treatment. Otherwise, the sheets are subjected to the sheet folding treatment by the sheet folding device 2 and then forwarded one by one through the conveying path 65 to the binder 5, piled, and subjected to the binding treatment.

The cover storing part 51 comprises a switch door 511, a cover retaining member 514, and lower storing guides 512 and 513 in order to store the covers C. When supplying the covers C therein, the switch door 511 is opened and a group of covers C is stored in an opened state with a back cover put between the lower storing guide 512 and 513 and a front cover against the cover holding part 514, namely in the shape of a letter V. Further, the cover storing part 51 is provided therein with a cover sensor SE51 for detecting the existence of a cover C. This cover sensor SE51 is, for example, a switch disposed in the part of the lower storing guide 512 contacting the back cover of the cover C. When the cover C touches and pushes this switch, a signal is transmitted to the finisher grade CPU 980 and the existence of the cover C is detected. An optical sensor or a contact sensor may be used instead of the switch mentioned above.

The cover conveying part 52 comprises a pickup roller 521 for contacting the back cover face of the cover C held therein and conveying the leading end of the cover C, a roller pressing member 522 for pressing the pickup roller 521 against the cover C, paired riffling rollers 523 for conveying only one cover C at a time, a front riffling member 524 disposed in the upstream of the paired riffling rollers 523, a cover detecting device 525 disposed in the downstream of the paired riffling rollers 523, paired cover conveying rollers 526 disposed in the downstream of the paired riffling roller 523, and cover conveying guides 527 and 528 so constructed as to connect the cover storing part 51 and the sheet inserting part 53.

The sheet inserting part 53 is composed of guide plates 531, 532, 533, and 534 jointly forming an empty space of the shape of an inverted triangle for the insertion of sheet, paired cover resisting rollers 535 disposed below the empty space for the insertion of sheet, a leading end stopper 536 disposed above the empty space for the insertion of sheet in the direction of conveyance of the cover, and a lateral aligning member 537 disposed inside the empty space for the insertion of sheet above the paired cover resisting rollers 535.

The leading end of the cover C which has been conveyed from the cover conveying part 52 advances upward along the guide plate 532 and collides against the leading end stopper 536. As the cover C is further conveyed, the back part of the cover C is bent downward and passed between the guides 531 and 532 until the lower end thereof is stopped by the paired cover resisting rollers 535.

After the elapse of a prescribed time after the detection of the passage of the back part of the cover C by a cover detecting sensor 538 disposed above the paired cover resisting rollers 535 (at the time that the back part of the cover C collides against the upper sides of the paired cover resisting rollers 535 and the trailing end of the cover C exists in the upstream of the paired cover conveying rollers 526), at least the upper roller of the paired cover conveying rollers 526 is retreated out of the boundary of the cover conveying path.

In consequence of the retreat of the cover conveying roller 526 and by dint of the stiffness of the front side of the cover C, the trailing end of the cover C is engaged with a depressed part 527*a* of the cover conveying guide 527 and the position of the trailing end of the cover C is consequently fixed. As a result, the cover C is set in the sheet inserting part 53 with the back part thereof mounted in the shape of a letter V on the paired cover resisting rollers 535 as indicated by a broken line in the diagram.

After the cover C has been set on the sheet inserting part 53, the lateral aligning member 537 is moved in a direction perpendicular to the direction of conveyance of the cover C and enabled to press the end face of the cover C against an aligning basis plate (not shown) disposed as opposed to the lateral aligning member 537 and fix the position of the end face.

The sheet conveying part 54 is provided in the conveying path 67 extended to the upper part of the paired cover resisting rollers 535 with paired conveying rollers 541 for conveying a bundle of sheets to the sheet inserting part 53 and a detecting sensor 543 for detecting the bundle of sheets in the conveying path 67. The bundle of sheets conveyed by the paired conveying rollers 541, therefore, is allowed to fall under its own weight into the cover C which is opened upwardly in the sheet inserting part 53. This gravitational fall serves the purpose of aligning the end parts of the sheets to be joined by adhesion.

The heating part 55 is composed of a heating plate 551 for heating the back part of the cover C conveyed from the inserting part 53, a heater 552 disposed below the heating plate 551, a reflecting plate 553 encircling the lower part of the heater 552 and shaped to concentrate the heat of the heater 552 on the heating plate 551, a heater supporting plate 554 for integrally supporting the heating plate 551, the heater 552, and the reflecting plate 553, an insulating member 555 mounted as a shield on the heater supporting plate 554, and a temperature sensor 556.

In the sheet inserting part 53, as the bundle of sheets is inserted into the cover C, the paired cover conveying rollers 526 press the end part of the cover C and at least one of the paired cover resisting rollers 535 retreats from the empty space for the insertion of sheet. Then, the paired cover resisting rollers 535 are rotated normally and, at the same time, the paired cover conveying rollers 523 are rotated to forward the cover C and the bundle of sheets to the heating part 55 below the sheet inserting part 53, stop the driving of the paired cover conveying rollers 526 and the paired cover resisting rollers 535, separate the paired cover conveying rollers 526 from each other, and cause the paired cover resisting rollers 535 to press the cover C and the bundle of sheets. This operation further aligns the end part of the bundle of sheets inside the cover C.

After the aligning operation is completed, the back part of the cover C on the heating plate 551 is heated at a proper temperature for a prescribed period with the cover C and the bundle of sheets kept under the pressure of the paired cover resisting rollers 535. Consequently, the adhesive agent applied fast to the back part of the cover C is melted and the cover C is joined by adhesion to the bundle of sheets. Thereafter, at the time that has been predicted to securely adhere the cover C and the bundle of sheets, the cover C and the bundle of sheets are discharged by normally rotating the paired cover resisting rollers 535.

The discharging part 56 is composed of a discharging guide 561, a blocking plate 562, and a discharging tray 563. The cover C which has been conveyed from the heating part 55 slides down the surface of the inclined discharging guide 561 under its own weight and is received in the discharging tray 563.

<<Processing of Copying Operation>>

Now, the processing effected in the reserved copying operation of the finisher 1 constructed as mentioned above and the copying machine 10*a* to which the finisher 1 is connected will be described.

Figure 6:
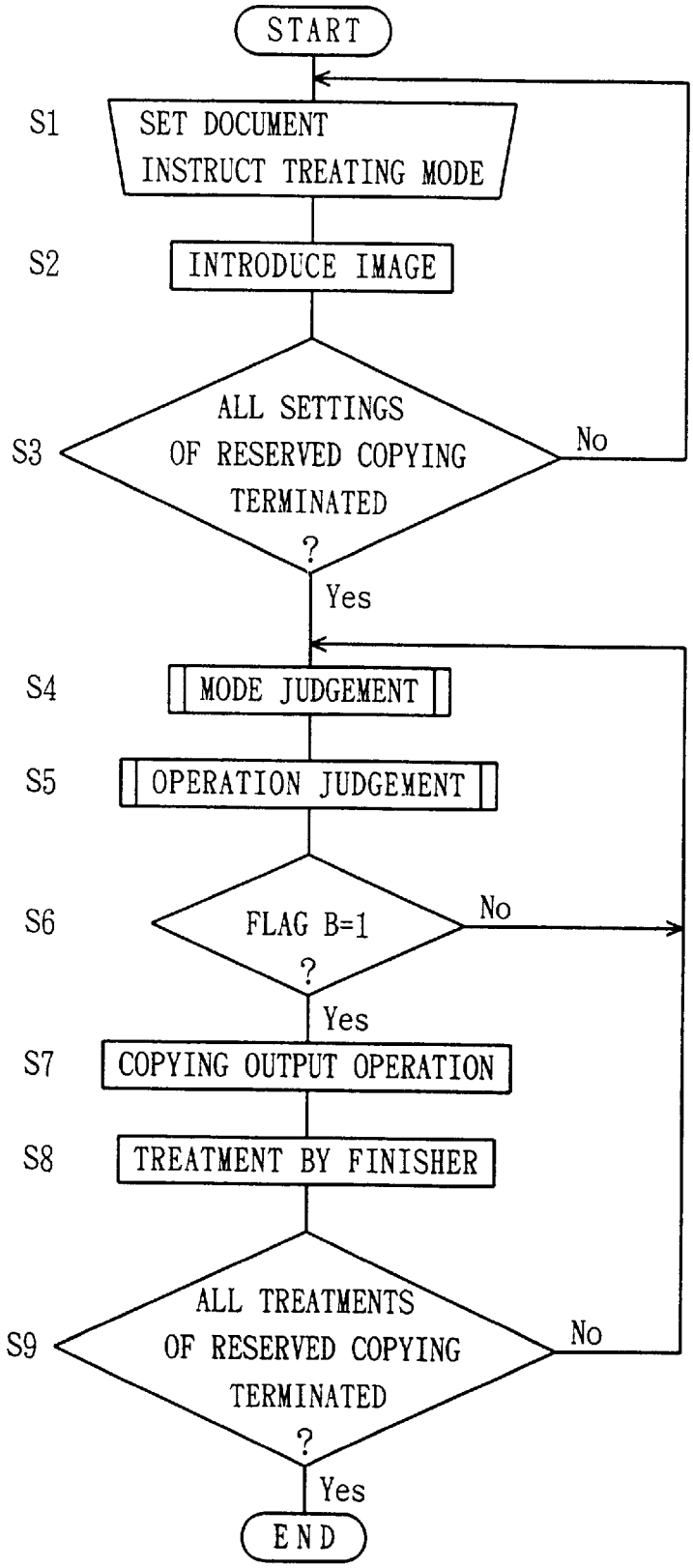
FIG. 6 is a main flowchart showing the operational procedure of the copying machine.

FIG. 6 is a main flowchart showing the flow of the whole processing of the copying operation.

When effecting a reserved copying operation, firstly, a document for the first job is introduced into the copying machine 10*a*. For this purpose, the document for the first job is set on the ADF 10C and treatment for the first job is instructed from the operating panel OP (S1). Then, an image of the set document is introduced (S2). The introduced document image is memorized in the image memory 825.

Then, the decision whether all settings of the reserved copying are terminated or not is made (S3). This decision is made by receiving a designation of termination of the reserved copying from the operation panel OP. If not terminated, introduction of the images of a plurality of documents for the second job, the third job, and so on and memorization of the treating mode of each job are effected in the same way as mentioned above. Here, the treating mode for each job is memorized as corresponding to the variable N, namely, the first job's treating mode as N=1, the second job's treating mode as N=2, and so on.

Then, the judgement about the feasible mode is effected (S4).

Then, it is decided whether the treatment of the mode judged feasible is immediately operable or not (S5).

Then, by checking the flag B (flag B is defined as B=1 when it is decided to be immediately operable at the step S5) (S6), if the flag B is 1 (immediately feasible), the copying output operation for the job to which the mode judged to be feasible is set is performed (S7). At this time, if there is a command such as enlargement or contraction, the copying operation is made after this processing. The copied sheet is discharged from the sheet discharging part 10*b* of the copying machine and accumulated in the sheet accumulating part 11*b* after being conveyed through the conveying path in the finisher 1. Then, the mode judged to be immediately operable is treated (S8). At the step S6, if the flag B is judged to be 0, then it returns to the mode judgement of the step S4.

Finally, it is judged whether all reserved treatments are terminated or not (S9). If not terminated, it returns to the mode judgement (S4) and, as described above, all treatments after the step S4 are carried out until all reserved copying operation are finished.

Figure 7:
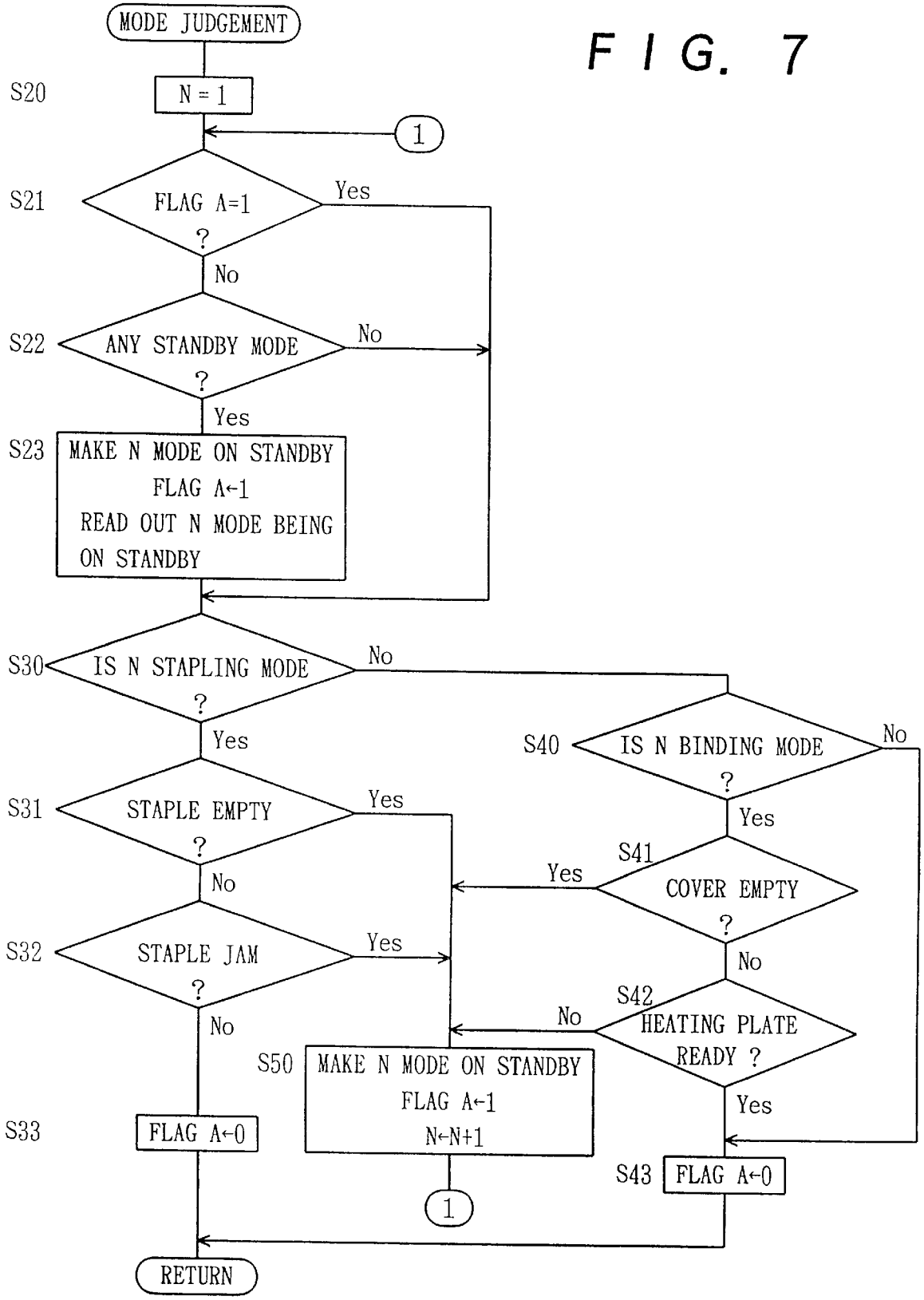
FIG. 7 is a flowchart showing the content of a subroutine of the mode judgment in the above main flowchart.

Next, a subroutine of the mode judgement of the step S4 will be described. FIG. 7 is a flowchart of the subroutine of the mode judgement.

At first, so as to perform the mode judgement in accordance with the order set as the reserved copying, the variable N is set to be 1 (S20). Then flag A is checked (S21). This flag A turns to be 1 when any of the modes using each device of the finisher 1, such as the stapler 3 and the binder 5, is judged to be unusable as described below.

When the flag A is 0 at this step S21, namely when all devices of the finisher 1 are usable, it is checked whether or not there is any treating mode which is on standby before this treatment (S22). The mode on standby is memorized in the RAM 912 provided for the copying machine grade CPU 910.

When there is a mode standing by, the mode to be carried out at present is memorized as a standby state with its value of N. Then, the flag A is turned to be 1, the mode having been in a standby state is inquired, and the value of the variable N containing that mode is read out (S23). Thereafter, the judgement whether each device is usable or not is made as described below.

When the flag A is 1 at the step S21, it is advanced directly to the step S30 and the judgement whether each device is usable or not is made.

Next, the judgement whether the mode to be treated is feasible or not is made. For that purpose, so as to decide which mode corresponds to the variable N, firstly, judgement whether it is the stapling mode or not is made (S30). Here, if the treating mode corresponding to the value of N is the stapling mode, the judgement whether the employ staple state is detected or not is made (S31). If the empty staple state is not detected, then the existence of a staple jam is checked (S32). If no staple jam is found, 0 is put in the flag A (S33) and it returns to the main routine. On the other hand, when the staple empty state is detected at the step S31 or when there exists the staple jam at the step S32, namely in the case when the stapling treatment is unfeasible, this value of N and its mode (in this case stapling treatment mode) are memorized as a standby state so as to make the mode corresponding to the N (stapling treatment mode) in a standby state, the flag A is turned to be 1, and 1 is added to the value of N for judging whether the treatment of the next job is feasible or not.

At the step S30, if the mode corresponding to N is other than the stapling mode, the judgement whether it is binding mode or not is made (S40). If it is binding mode, the judgement whether it is in a dedicated cover empty state or not is made (S41). If it is not empty, then the judgement whether the heating plate 551 is heated enough for the adhesion (state of heating plate ready) or not is made (S42). If the heating plate 551 is heated enough, 0 is put in the flag A (S43) and it returns to the main routine.

In case, at the step S41 or S42, it is judged to be the dedicated cover empty state or that the heating plate 551 is not heated sufficiently, in the same way as mentioned above, it is advanced to the step S50 and, in order to make the mode corresponding to the N (in this case binding mode) to be on standby, this value of N and its mode (binding mode) are memorized as a standby state, flag A is turned to be 1 and 1 is added to the N so as to make a judgement whether the treatment for the document of the next job is feasible or not (S50). The reasons why the judgement whether the heating plate 551 is heated enough or not are that it needs a few minutes for the heating plate 551 to be heated and therefore other treatments can be performed in the meanwhile and that other treatments can be performed in the case when the heating plate 551 is not heated by the failure of the heating part 55.

On the other hand, if it is judged not to be the binding treatment mode at the step S40, another treating mode such as, for example, the sheet folding or the punching treatment, is possibly set and, in order for these treatments to be performed, advance to the step S43 is made where 0 is put in the flag A to effect each treatment.

After the treatment of the step S50, return is made to the step S21 and the judgement for the next job is made. For example, if either the stapling treatment or the binding treatment is on standby and the flag A is turned to be 1, 1 is added to the N and then the judgement for the next job is made.

By each treatment mentioned above, therefore, the mode judgement is made so as to carry out the feasible treatment prior to the unfeasible ones in spite of the order introduced as the reserved copying.

Figure 8:
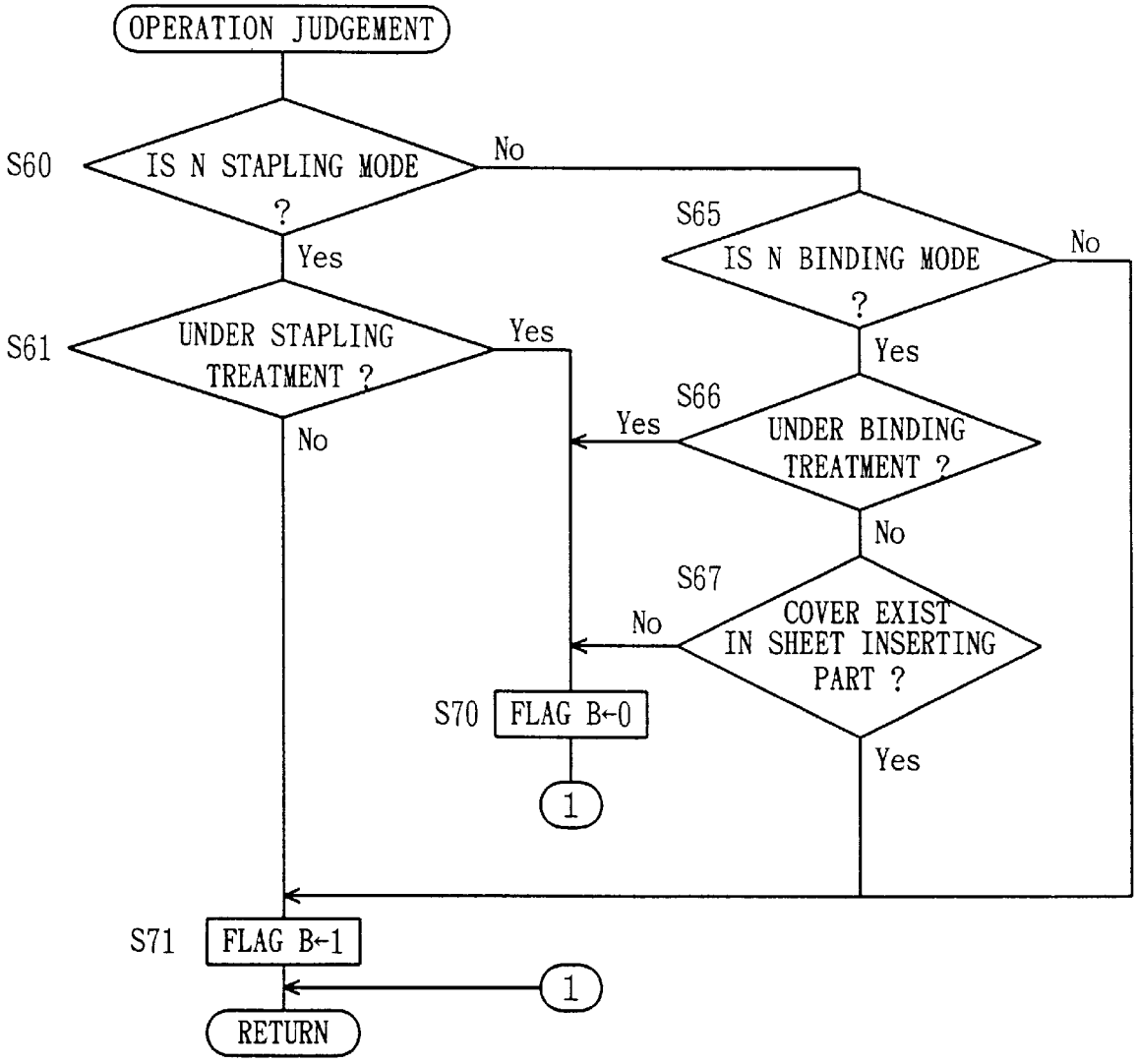
FIG. 8 is a flowchart showing the content of a subroutine of the operation judgment in the above main flowchart.

Next, the subroutine of the operation judgement of the step S5 will be described. FIG. 8 is a flowchart of the operation judgement subroutine.

In the operation judgement, firstly, it is decided whether the mode corresponding to the variable N is the stapling mode or not (S60). If it is the stapling mode, the judgement whether the stapling treatment is being performed at this time of the judgement or not is made (S61). If it is not under the stapling treatment, the treatment can be immediately started, then 1 is put in the flag B (S71) and it returns. On the other hand, if the stapling treatment is being performed, it can not be carried out immediately, then, 0 is put in the flag B (S70) and it returns. Accordingly, if the stapling treatment is to be carried out immediately, in accordance with the treatments after the step S6 of the main routine, the copying output operation and the stapling treatment by the finisher 1 are performed. On the other hand, if the stapling treatment is not feasible immediately, it returns to the step S4 and the mode judgement is made so as to search another feasible treatment.

When it is judged not to be the stapling mode at the step S60, it is decided whether the mode corresponding to the variable N is the binding mode or not (S65). If it is the binding mode, the judgement whether the binding treatment is being performed at this time of the judgement or not is made (S66). If it is not under the binding treatment, the judgement whether a dedicated cover exists in the sheet inserting part 53 or not is made (S67). If the dedicated cover exists, the treatment can be immediately started, 1 is put in the flag B (S71) and it returns. On the other hand, when it is judged that the binding treatment is being performed at the step S66 or when it is judged that the dedicated cover exists, the binding treatment cannot be carried out immediately, then, 0 is put in the flag B (S70) and it returns. Accordingly, if the binding treatment is to be carried out immediately, in accordance with the treatments after step S6 of the main routine, the copying output operation and the binding treatment by the finisher 1 are performed. On the other hand, if the binding treatment is not feasible immediately, it returns to the step S4 and the mode judgement is made so as to search another feasible treatment.

By the above routine of the operation judgement, is different than from the above mode judgement, in the case where the individual treatment cannot be performed immediately another feasible treatment is performed even though there is no trouble disturbing the treatments of the finisher such as staple empty or binding cover empty, another feasible treatment than that unfeasible treatment is to be performed in advance.

As mentioned above, when a reserved copying is set, if there is any trouble for a treatment to be carried out, such as staple empty, staple jam, binding cover empty, or insufficient heating of the binding heating plate 551 condition and, moreover, if the treatment to be carried out is unfeasible due to the fact that the treatment is being performed, instead of the treatment which cannot be performed immediately, another feasible treatment than that unfeasible treatment can be carried out in advance.

Incidentally, the finisher of this invention is not limited to the form in which it is connected to a copying machine and utilized. It can also be effected in the form of being connected to an image forming apparatus such as a printer or a facsimile.

Although the above embodiment has been described on the assumption of a reserved copying, this invention, not limited to the case of the reserved copying, is applicable. For example, when a treatment turns to be unfeasible during its treatment, if there is any feasible treatment such as made by interruption, this feasible treatment will be performed in advance.

Application No. 8-351547 filed on Dec. 27, 1996 including specification, claims, drawings and summary are incorporated herein by reference in its entirety.

What is claimed is:

1. A finisher for connection to an image forming apparatus for forming an image on a sheet, said finisher adapted to perform a work on the sheet discharged from the image forming apparatus, the finisher comprising:

a stapling device for effecting a stapling treatment on a plurality of sheets discharged from the image forming apparatus;

a binding device which inserts the plurality of sheets discharged from the image performing apparatus into a cover having an inner surface and having a fusible adhesive agent applied to the inner surface of the vicinity of a back part connecting front and back covers thereof and heats the back part of the cover to bind by adhesion the plurality of sheets and the cover for bookbinding;

a treatment memory device for memorizing a treatment by said stapling device or said binding device as a treating mode in advance of the treatment;

a staple detecting device for detecting the existence of a staple necessary for the stapling treatment executed by said stapling device;

a cover detecting device for detecting the existence of the cover necessary for the bookbinding treatment executed by said binding device; and a controlling device which controls said stapling device or said binding device so as to automatically execute, when a lack of a staple or a cover is detected either by said staple detecting device or said cover detecting device, a stapling or binding treatment memorized by said treatment memory device instead of executing an unfeasible stapling or binding treatment.

2. A finisher according to claim 1, wherein said binding device comprises:

a cover storing part for storing a plurality of the covers;

a cover conveying part which extracts one cover from said cover storing part and conveys it;

a sheet inserting part which supports the cover conveyed by said cover conveying part in such an opened state as to enable the plurality of sheets to be received therein;

a sheet conveying part for conveying the plurality of sheets discharged from the image forming apparatus to said sheet inserting part and inserting them into the cover;

a heating part for heating the back part of the cover in which the sheets are inserted;

a temperature detecting device for detecting the temperature of said heating part; and a discharging part for discharging a bound booklet formed by binding the plurality of sheets in the cover which is produced by a heating treatment of said heating part; and said controlling device makes a feasible treating mode other than a treating mode using said binding device for the treating mode memorized in said treating mode memory device executed prior to the treating mode using said binding device when said temperature detecting device detects if said heating part is not heated enough for the binding treatment.

3. A finisher comprising:

a stapler which effects a stapling treatment on a plurality of sheets;

a binder which inserts the plurality of sheets into a cover and glues the plurality of sheets and the cover for bookbinding;

a memory which memorizes desired functions of said stapler and said binder in advance of treatment by said stapler and said binder; and a controller which controls said stapler and said binder, said controller automatically executing a feasible stapler or binding function of the treating functions memorized in said memory instead of executing an unfeasible stapler or binding function.

4. A finisher according to claim 3, wherein said unfeasible stapler function occurs as a result of no available staple.

5. A finisher according to claim 3, wherein said unfeasible binding function occurs as a result of no available cover.

6. A finisher according to claim 3, wherein said unfeasible stepler function occurs as a result of a staple jam.

7. A finisher according to claim 3, wherein said binder comprises:

a cover storing part for storing a plurality of covers; and a cover conveying part for extracting one cover from said cover storing part and conveying it.

8. A finisher according to claim 3, wherein said binder comprises a discharging part for discharging a bound booklet formed by binding the plurality of sheets in the cover.

9. A finisher according to claim 3, wherein said binder comprises a sheet inserting part which supports the cover in such an opened state as to enable the plurality of sheets to be received therein.

10. A finisher according to claim 9, wherein said binder comprises a sheet conveying part for conveying the plurality of sheets to said sheet inserting part and inserting them into the cover.

11. A finisher according to claim 3, wherein said cover has an adhesive agent applied to the inner surface thereof.

12. A finisher according to claim 11, wherein said adhesive agent is applied to the inner surface of the vicinity of a back part connecting front and back covers of the cover.

13. A finisher according to claim 11, wherein said adhesive agent is fusible.

14. A finisher according to claim 13, which is provided with:

a heating part for heating the back part of the cover in which the sheets are inserted; and a temperature sensor for detecting the temperature of said heating part, wherein said controller makes a feasible treating mode other than a treating mode using said binder for the treating mode memorized in said memory executed prior to the treating mode using said binder when said temperature sensor detects the fact that said heating part is not heated enough for the binding treatment.

15. A finisher according to claim 3, which is connected to an image forming apparatus for forming an image on a sheet and performs a work on the sheet discharged from the image forming apparatus.

16. A finisher according to claim 15, wherein said binder comprises:

a cover storing part for storing a plurality of covers; and a cover conveying part for extracting one cover from said cover storing part and conveying it.

17. A finisher according to claim 16, wherein said binder comprises a sheet inserting part which supports the cover conveyed by said cover conveying part in such an opened state as to enable the plurality of sheets to be received therein.

18. A finisher according to claim 17, wherein said binder comprises a sheet conveying part for conveying the plurality of sheets discharged from the image forming apparatus to said sheet inserting part and inserting said plurality of sheets into the cover.

19. A finisher incorporating therein a plurality of finishing parts for bundling a plurality of sheets and effecting a bookbinding, comprising:

a memory which memorizes desired functions of said finishing parts in advance of activation of said finishing parts; and a controller which controls the plurality of finishing parts, said controller automatically controlling a feasible finishing part for a function memorized in said memory to activate the feasible finishing part instead of a finishing part in an unfeasible state.

20. A finisher according to claim 19, wherein said plurality of finishing parts comprises:

a stapling part for binding the bundle of sheets with a staple; and a binding part for binding by adhesion the bundle of sheets with a cover.

21. A finisher according to claim 20, wherein in said unfeasible state, staple(s) are not available to the stapling part.

22. A finisher according to claim 20, wherein in said unfeasible state, cover(s) are not available to the binding part.

23. A finisher according to claim 20, wherein in said unfeasible state, a staple is in a jammed state.

24. A finisher according to claim 20, wherein said cover has a fusible adhesive agent applied thereto.

25. A finisher according to claim 24, wherein said binding part performs the bookbinding by melting the fusible adhesive agent with a heater.

26. A finisher according to claim 24, further having a temperature sensor to determine whether the heater is in bad condition wherein said unfeasible state is the case when the heater is in said bad condition as determined by said temperature sensor.

27. A finisher which is connectable to an image forming apparatus for forming an image on a sheet and which is adapted to perform work on the sheet discharged from the image forming apparatus, the finisher comprising:

a first device which binds a plurality of sheets discharged from the image forming apparatus in a first manner;

a second device which binds a plurality of sheets discharged from the image forming apparatus in a second manner, which is different from said first manner, at least one of said first device and said second device being a non-stapling binding device;

a detector which detects whether either of the first or second devices is in an unfeasible state; and a controller which controls said first and second devices so as to automatically execute a binding treatment by using a feasible device instead of a binding treatment of an unfeasible device.

28. A finisher according to claim 27, wherein said second device includes a heater, which melts an adhesive agent for binding the plurality of sheets, and said detector detects that a temperature of the heater is high enough for binding the plurality of sheets.

29. A finisher according to claim 27, wherein said first device binds the plurality of sheets with first binding materials, said second device binds the plurality of sheets with second binding materials, which are different from said first binding materials, and said detector detects whether the first device or the second device is empty of the first or second binding materials, respectively.

30. A finisher according to claim 29, wherein said first binding materials include staples, and said second binding materials include cover sheets.

* * * * *